United States Patent [19]

Yost

[11] 4,195,499

[45] Apr. 1, 1980

[54] TRANSFER PRINTING APPARATUS

[76] Inventor: John A. Yost, 259 N. 10th St., Kansas City, Kans. 66102

[21] Appl. No.: 889,331

[22] Filed: Mar. 22, 1978

[51] Int. Cl.[2] ..... D06P 1/00; B41F 3/52; B41F 17/10; B44C 1/16

[52] U.S. Cl. ..... 68/5 D; 8/2.5 A; 101/470; 156/583.5

[58] Field of Search ..... 101/470; 8/2.5 A; 68/5 C, 5 D; 156/583

[56] References Cited

U.S. PATENT DOCUMENTS

| | | | |
|---|---|---|---|
| 2,273,740 | 2/1942 | Terry | 101/170 |
| 2,594,290 | 4/1952 | Chavannes | 101/470 |
| 3,046,771 | 7/1962 | Bailey | 68/5 C |
| 3,170,395 | 2/1965 | Gundlach et al. | 101/470 |
| 3,768,280 | 10/1973 | Kanneglesser et al. | 101/470 |
| 3,848,435 | 11/1974 | Armstrong | 8/2.5 A |
| 3,915,628 | 10/1975 | Bossard et al. | 101/470 |
| 4,117,699 | 10/1978 | Renaut | 101/470 |

FOREIGN PATENT DOCUMENTS

| | | | |
|---|---|---|---|
| 2255898 | 5/1974 | Fed. Rep. of Germany | 101/470 |
| 2410214 | 9/1974 | Fed. Rep. of Germany | 101/470 |
| 1423358 | 2/1976 | United Kingdom | 8/2.5 R |

*Primary Examiner*—Clyde I. Coughenour
*Attorney, Agent, or Firm*—Fishburn, Gold & Litman

[57] ABSTRACT

An apparatus for transfer printing of discrete articles comprises a frame having a rotating heat drum mounted therein, and a planar work surface member which extends perpendicularly of the heat drum, and includes a guide member at the forward end thereof. A first endless belt extends over the heat drum and the guide member, and has an upper, feed side thereof supported on the work surface member, thereby forming a planar work area for laying out and aligning a transfer and an associated article to be printed. A second endless belt is mounted in the frame, overlies a printing end of the first belt, and translates syncronously with the first belt. The first and second belts are urged against the heat drum, whereby translation of the belts conveys the assembled transfer and article from the work area to a position between the belts for printing under heat and pressure, and subsequently into a discharge tray.

13 Claims, 5 Drawing Figures

TRANSFER PRINTING APPARATUS

BACKGROUND OF THE INVENTION

This invention relates to printing devices, and in particular to an appratus and method for the transfer printing of discrete articles.

Transfer printing with heat is generally termed sublimation printing, and consists of a dry printing process, wherein dispersion dyestuffs are preprinted on a suitable transfer or carrier, and are transferred and fixed to an article of cloth, paper, or the like, thereby printing the pattern and/or indicia of the transfer onto the selected article. With the transfer and article positioned in an aligned and overlying relationship, heat and pressure are applied thereto, thereby converting the dyestuffs into a vapor which contacts and/or penetrates the adjacent surface of the article to effect the printing process.

Transfer printing methods are used for the continuous printing of very large rolls of material with a reoccuring pattern, as well as for the custom printing of discrete articles, such as bedding, shirts, blouses, sweaters, dresses, tablecloths, needle point canvases, and the like. In the latter type of application, clear and accurate line transfer is usually required, and special paper-type transfers, in sheet form, are typically printed individually on a discrete aritcle by a static press-type machine having a pair of flat, heated plates. Such machines produce fairly accurate reproduction, but are very large and cumbersome, and are quite limited as to the size of the article which may be printed therein. Heretofore, roller type printers have not been suitably adapted for the custom printing of discrete articles.

A very high degree of outline clarity and color brightness is required in the printing of artistic prints for ornamentation and display, particularly large works, such as wall hanging, large simulated tapestries, murals, and the like. Heretofore, the problems associated with the transfer printing of such large works have proven sufficiently serious to render the same commercially impractical. Because of the large area of material involved, nonuniform pressure and heat often causes blurry and/or distorted image reproduction, irregular color patterns, and blotching, as well as wrinkles in the material and/or transfer which produce unsightly lines through the print.

SUMMARY OF THE INVENTION

The principal objects of the present invention are: to provide a transfer printing machine for clearly and accurately printing intricate prints; to provide such a machine which is particularly designed for the custom printing of large, non-repetitive, artistic prints; to provide such a machine which vividly reproduces transfer colors and sharp pattern lines; to provide such a machine having a pair of endless belts, between which an article and transfer pass for uniform hearing and indicia transfer; to provide such a machine having a planar work surface for laying out and aligning the article and transfer prior to passing the same between the belts for printing; to provide such a machine for printing at a reduced temperature and pressure; to provide such a machine having a direct drive arrangement for preventing lateral slippage between the endless belts; to provide such a machine having a spoked heat roller mating with apertures disposed along the side edges of the belts for preventing longitudinal slippage or creep therebetween; to provide such a machine wherein the belts are constructed of a woven glass fiber material for uniform heating of the transfer; to provide such a machine wherein the printing surfaces of the belts are coated with an impermeable material to prevent dyestuffs from collecting on the belt; to provide such a machine wherein pressure between the transfer and article is applied through belt tension for uniform pressure thereon; and to provide such a machine which is efficient in use, capable of a long operating life, and particularly well adapted for the proposed use.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

Referring more in detail to the drawings:

As required, detailed embodiments of the present invention are disclosed herein, however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present ivention and virtually any appropriatley detailed structure.

Figure 1:
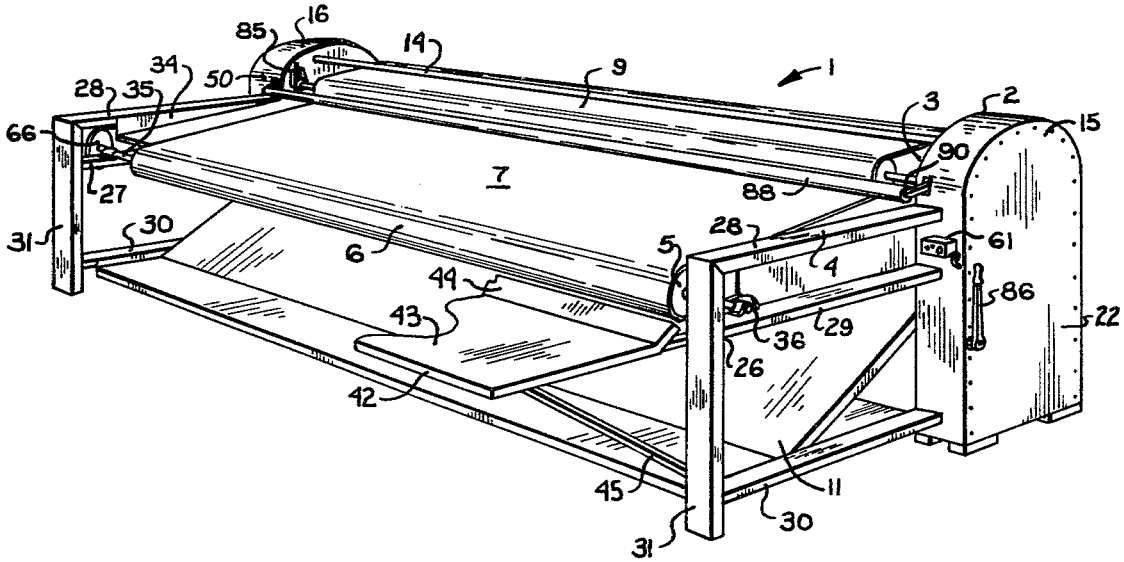
FIG. 1 is a perspective view of a transfer printing machine embodying the present invention, with a portion broken away.

For purposes of description herein, the terms "upper", "lower", "right", "left", "rear", "front", "vertical", "horizontal ", and derivitives thereof, shall relate to the invention as oriented in FIG. 1, however, it is to be understood that the invention may assume various alternative orientations, except where expressly specified to the contrary.

The reference numeral 1 generally designates a transfer printing machine embodying the present invention adapted for printing discrete articles. The printing machine 1 comprises a frame 2 having a rotating heat drum 3 mounted therein, and a planar work surface member 4 which extends substantially perpendicularly of the heat drum 3 and includes a guide member 5 at the forward end thereof. A first endless belt 6 extends over the heat drum 3 and the guide member 5, and has an upper, feed side 7 supported by a planar poriton 8 of the work surface member 4, thereby forming a flat work area for laying out and aligning a transfer and an associated article to be printed. A second endless belt 9 is mounted in the frame 2, overlies a printing end of the first belt 6, and translates syncronously with the first belt. The first and second belts 6 and 9 respectively are urged against the heat drum 3, whereby translation of the belts conveys the assembled transfer and article from the work area to a position between the belts for printing, and subsequently into a discharge tray 11.

Figure 3:
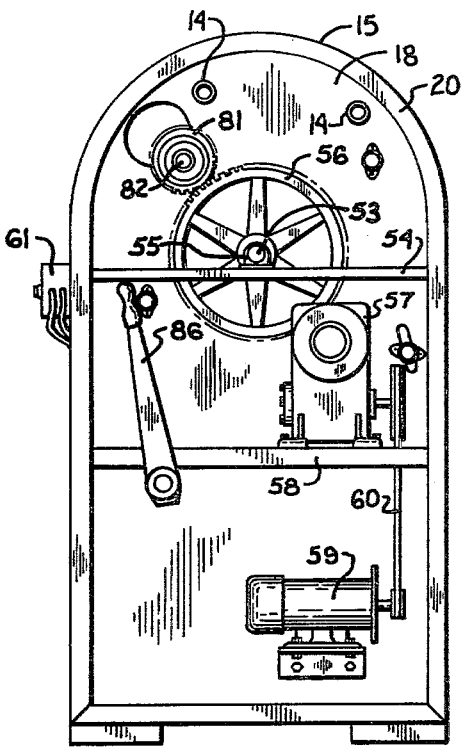
FIG. 3 is an elevational view of one end of the printing machine with a cover poriton thereof removed to reveal internal construction.
Figure 4:
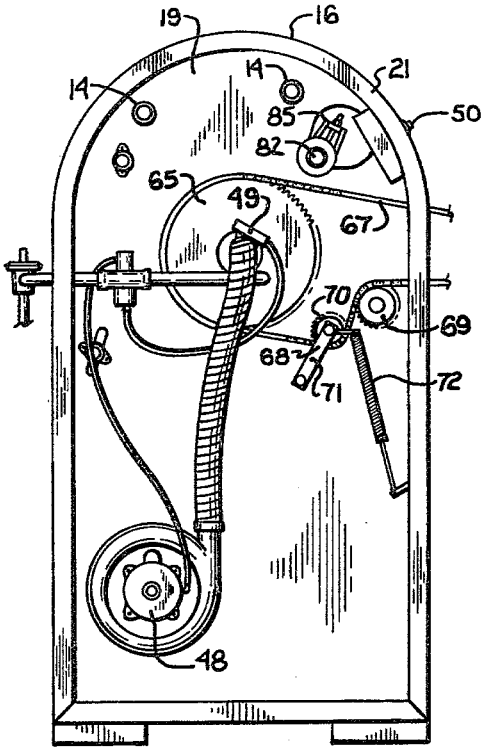
FIG. 4 is an elevational view of the other end of the printing machine, having a cover member thereof removed to reveal internal construction.

The frame 2 comprises a pair of laterally spaced end members 15 and 16 which are interconnected at base portions thereof by sapced apart structural channel members 17, and at an upper portion thereof by tubular members 14. The heat drum 3 extends transversely between the end members 15 and 16 and is mounted in the upper portion thereof, and assists in the interconneciton of the end members. As best illustrated in FIGS. 3 and 4, the end members 15 and 16 of a hollow construciton having a back plate 18 and 19, and a side wall 20 and 21 respectively, and forming a housing in which internal drive portions of the printing machine are retained. A cover plate 22 is detachably connected to each of the end members side walls 20 and 21 by suitable fastening means, and forms a closure for the same.

A pair of guide member supports 26 and 27 are connected with and extend forwardly of the end members 15 and 16 respectively. Each of the guide member supports includes three horizontally oriented braces 28, 29 and 30 which are interconnected by a vertically positioned leg 31. The planar portion or top 8 of the work surface member 4 extends laterally between the upper braces 28 and is rigidly attached thereto to form a sturdy, planar surface on which the feed side 7 of the first belt 6 is abuttingly supported. The illustrated top 8 is inclined upwardly from front to rear at an angle in the nature of ten degrees to improve operator visibility of the printing process and to lower the front end of the machine to a convenient working height. The forward most end 32 of the top 8 is positioned vertically in line with the upper side of the guide member 5, and the rearward end 33 thereof is positioned adjacent to the heat drum 3. The top 8 of the work surface includes a pair of laterally adjustable side guides 34 connected along the side edges of the top for centering the transfer and article, and feeding the same squarely into the heat drum. The side guides 34 taper laterally inwardly toward the rear of the machine to facilitate feeding the transfer and article, and are typically spaced at their inward ends a distance substantially coextensive with the width of the transfer and article.

In the illustrated structure, the belt guide member 5 comprises a roller having a shaft 35 projecting axially thereof, and is mounted in bearing blocks 36 on the medial brace member 29 at the forward-most portion thereof. A base plate 37 extends between the lower braces 30 of the work surface member and is fixedly attached thereto. The rearward and forward edges 38 and 39 of the base plate are disposed respectively adjacent the end members 15 and 16, and the legs 31. The discharge tray 11 also extends between the end members 15 and 16 and is attached at the forward end 40 thereof to the base plate 37 a spaced apart distance from the base plate forward edge 39. The discharge tray 11 extends rearwardly and upwardly from the base plate 37 at an angle in the nature of 30 degrees to a rear edge 41 which is positioned directly below a discharge area of the belts 6 and 9.

A preparation tray 42 is attached to and extends between and forward of the legs 31, and facilitates aligning the transfer and article. The tray 42 comprises flat plate 43 disposed substantially horizontally an upwardly inclined end member 44, and a pair of angled support braces 45. The tray 42 is shaped to receive and retain a rolled transfer and/or article thereon, whereby the rolls are supported at a convenient work height while the transfer and article are being aligned by the operators. The end member 44 guides the materials onto the feed surface of the belt 6, and the plate 43 may be provided with a recessed portion (not shown) for secure retention of the rolled article and transfer.

The heat drum 3 is an elongate, hollwo, cylindrical sutrcture which extends between the end members 15 and 16 and includes a smooth outer surface 46. The heat may be supplied by steam, electric coils, natural gas burners, or the like, and is injected into the central cavity portion of the heat drum, thereby raising the temperature of the outer surface and imparting heat to the transfer to effect printing on the article. In the illsutrated structure, a perforated natural gas orifice 47 is positioned coaxially within the heat drum, and an air-gas mixture is supplied thereto by a pump mechanism 48. the air-gas mixture is ignited at the surface of the orifice 47 and transfers heat by convection and radiation to the heat drum 3. In this example, a thermostat 49 is positioned outside the drum cavity and is electrically connected with a control mechanism 50 and the gas supply to selectively control the temperature of the heat drum. A hood and fan arrangement (not shown) may be positioned over the printing machine to remove the hot exhaust gases of the heat drum 3 from the work area.

As best illustrated in FIG. 3, the heat drum 3 is rotatably mounted on a shaft 53 which extends through the associated back plate 18, and is connected to a lateral brace 54 by a bearing 55. A spur gear 56 is attached to the shaft between the bearing 55 and back plate 18, and is entrained with a mating gear portion of a speed reducer 57. In the illustrated structure the speed reducer 57 is connected with a second, laterally extending brace 58, and is driven by an electrical motor 59 and belt and pulley arrangements 60. A speed control mechanism, such as the illustrated rheostat 61 is electrically connected with the motor 59 and controls the rotational speed of the heat drum.

The first belt 6 extends between and is mounted on the heat drum 3 and the guide roller 5. The feed side 7 of the belt is defined as that portion of the belt that overlies the supporting planar member or top 8, and the printing end 10 thereof extends arcuately around and abuts the heat drum 3. The belt 6 also includes a return side 64 which is disposed below the work surface 4 and extends between the lower sides of the heat drum 3 and guide roller 5. In the example shown in FIG. 4, direct drive means operably interconnect the heat drum 3 and the guide roller 5 for positive, synchronous translation of the belt 6. The direct drive means includes a pair of sprockets 65 and 66 (FIG. 1) which are connected to the heat drum 3 and guide roller shaft 35 on the left hand side of the machine. A flexible drive chain 67, such as the illustrated roller chain, interconnects the two sprockets 65 and 66, such that both ends of the belt 6 are driven. An automatic slack adjuster 68 is positioned in the left hand end member 16, and inlcudes a first idler sprocket 69 attached to the back panel 19, a second idler sprocket 70 connected to the free end of a rotatably mounted arm 71. A resilient spring member 72 urges the arm 71 and second idler sprocket 70 in a clockwise direction (as viewed in FIG. 4) to keep the roller chain 67 in a taut condition. The diameters of the sprockets 65 and 66 are sized in accordance with the diameter of the heat drum 3 and guide roller 5, whereby the translational or linear speed at the outer surface of each is identical.

Figure 2:
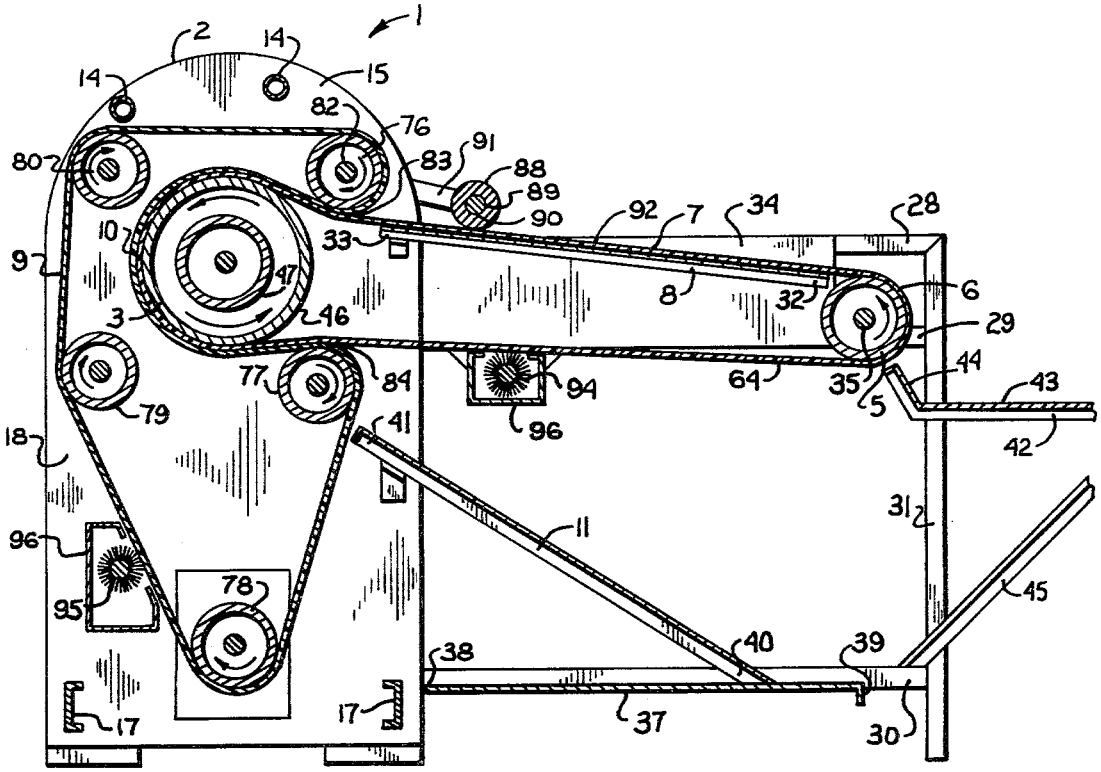
FIG. 2 is a partially schematic cross-secitonal view of the printing machine taken along a medial poriton thereof.

The second belt 9 is mounted in the frame 2, overlies the printing end 10 of the first belt 6, and translates synchronously therewith. The second belt 9 extends between, and is mounted on a feed roller 76, a discharge roller 77 and a return roller 78, each of which extends transversely between the frame end members 15 and 16 and is rotatably mounted therein. The feed and discharge roller 76 and 77 are positioned slightly forwardly of the center of rotation of the heat drum 3, and are vertically oriented on the upper and lower sides thereof respectively. The printing end 10 of the belt 6 is defined as that portion thereof which overlies the second belt 9 between the feed and discharge rollers, and extends over the heat drum. In this example, the return roller 78 is positioned adjacent the base portion of the frame end members, and extends between a medial portion of the ends, and a pair of idler rollers 79 and 80 extend between the frame end members 15 and 16 and are rotatably mounted adjacent the rear portions thereof. The upper idler roller 80 is disposed slightly above the upper side of the heat drum 3, and feeds the second belt 9 to the feed roller 76. In the illustrated structure, a gear 81 (FIG. 3) is attached to the feed roller drive shaft 82, and is entrained with the heat drum gear 56, whereby the feed roller 76 positively and directly drives the second belt 9 for synchronous translation with the first belt 6. As best shown in FIG. 2, the feed and discharge rollers 76 and 77 are positioned inwardly of the uninterupted line of extension of the first belt 6, whereby the first and second belts converge at a feed point 83, extend in an overlying fashion arcuately about the peripheral portion of the heat drum, and diverge at a discharge point 84. In this example, the belts extend around the drum an arcuate measure in the nature of 225 degrees.

Each of the belts includes a tightening means for stretching the same into a taut condition. Since neither the feed roller 76 nor the discharge roller 77 abut the heat roller, the compressive pressure applied to the assembled transfer and article is developed from, and dependent upon, the tension in each of the belts. As a result of this arrangement, the pressure applied to the transfer and article is very uniform. The guide roller shaft bearings 36 are adjustably fastened to the medial brace 29, such that the guide roller 5 and shaft 35 may be selectively translated inwardly and a outwardly with respect to the heat drum 3 to adjust the tension in the first belt 6. The feed roller shaft 82 is attached to the end plates 18 and 19 by a spring loaded, pivotal mounts 85 (FIGS. 1 and 4). The pivotal mount 85 is in turn attached through a conventional lever arrangement (not shown) to a control lever 86, whereby rotation of the control level toward the front of the machine pivots the pivotal mounts 85 and feed roller 76 in a clockwise direction (as viewed in FIG. 2) about the heat drum shaft 53. This rotation of the feed roller 76 elongates both of the belts 6 and 9, thereby increasing the compressive pressure applied to the transfer and article. The angular position of the control lever 86 may be varied and then locked into plate to selectively obtain the desired printing pressure.

An auxiliary smoothing roller 88 is attached to and extends laterally across the machine at the rearward portion of the work area, and functions to slightly compress the assembled transfer and article to smooth the same and remove wrinkles therefrom. The illustrated roller 88 includes a center core or shaft 89, and a thick resilient cover 90 attached in the end members 15 and 16. The weight of the roller 88 supplies sufficient force to smooth the wrinkles from the transfer and article assembly.

A safety device is attached to the roller 88, and is operably connected with the motor 59, whereby objects inadvertently situated between the first belt 6 and a roller activated the latter and deactivates the motor thereby haulting translation of the belts 6 and 9. The brackets or arms 91 allow the roller 88 to translate vertically a limited amount, and a switch mechanism (not shown) is attached thereto to detect such vertical translation. Should an object, such as the operator's hand become inadvertently situated between the belt 6 and the roller 88, the roller is translated upwardly, thereby activating the switch and deactivating the motor 59 to prevent the object from contacting and/or being exposed to the heat drum 3.

The first and second belts have a substantially coextensive width and extend adjacent the opposed sides of the machine and side guides 34. The belts are preferably constructed of a flexible, insulative substances, such as woven glass fiber material for uniform heating of the transfer and article assembly under pressure, and long lasting operation. Both of the belts have an exterior surface 92 which is oriented toward the heat roller, at the printing end of the belt, and the same are preferably coated with a polytetrafluoroethylene material which resists the penetration of the sublimation dies in the transfer, whereby dyestuffs which vaporize and flow toward the belts will not stick to the surface thereof. The width of the illustrated belts 6 and 9 is very large, in the nature of 110 inches, to accommodate large prints. As a result of this large width, in combination with thermal expansion in the belts, the belts have a tendency to translate unevenly both with respect to their lateral and longitudinal dimension. At the printing end 10 of the belts, uneven belt translation causes one belt to translate with respect to the other, whereby one belt will slip or creep over the other. This creeping results in a blurred printed image of very poor quality. Direct drive of the belts by the guide roller 5, feed roller 76, and heat drum 3 substantially alleviates uneven belt translation.

As best illustrated in FIG. 2, each of the belts 6 and 9 is provided with a cylindrical brush member 94 and 95 respectively which remove objects such as lint, dust, or other foreign particles from the outer surface 92 of the belt. In this example, the brush 94 is positioned on the return side of the first belt 6, and the other brush 95 is positioned between the return roller 78 and first idler roller 79 on the second belt 9. Each of the brushes extends transversely along the length of the associated belt, and includes a housing member 96 in which the foreign material is collected.

Figure 5:
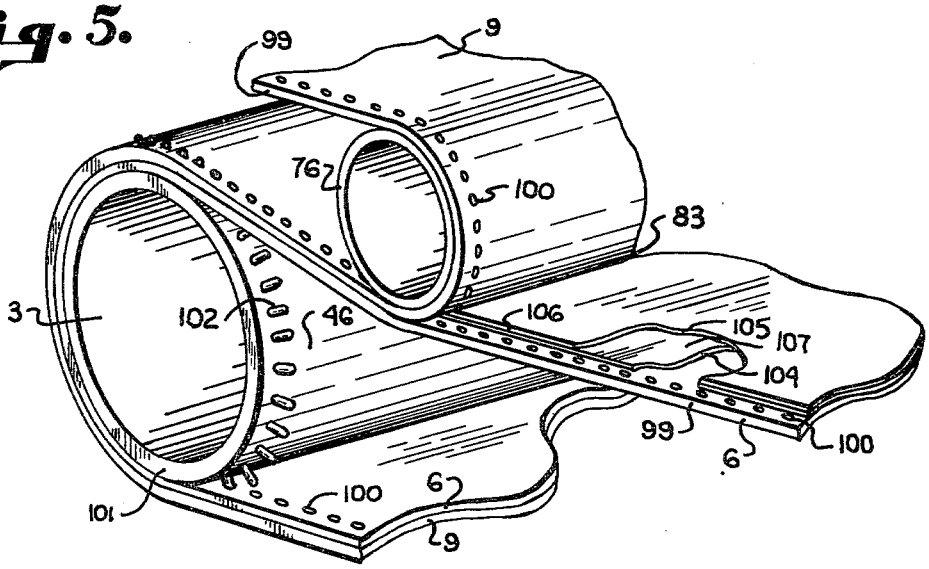
FIG. 5 is a partially schematic, perspective view of the printing machine, and an article and transfer therein, particularly showing a sprocketed heat drum portion.

A second embodiment of the present invention is illustrated in FIG. 5 and is substantially similar to the first described embodiment. In this embodiment, the belts 6 and 9 have opposed side edges 99 with a plurality of regularly spaced apertures or perforations 100 therealong. The heat drum 3 includes a spocket 101 at each end thereof having radially extending, circumferentially spaced teeth 102 which mate with the perforation 100 and align the first and second belts, and alleviate creep or relative translation between the belts as they pass over the heating drum. In this example, each of the perforations has a generally oblong shape, with a longer axis thereof aligned with the side edge 99 of the belts to accomodate meshing with the sprocket teeth.

In use, the operator first adjusts the thermostat control 50 and activates the gas orifice mechanism to heat the heat drum to the desired temperature level. The motor 59 is simultaneously energized to initiate belt translation, and the rheostat 61 is adjusted to control the rotational speed of the heat drum in accordance with the time period the user desires the transfer and article to be subjected to heat at the preselected temperature and pressure. As best illustrated in FIG. 5, the machine is adapted to print with a transfer 104 and an article 105 assembled in overlying fashion. If the transfer 104 and article 105 are rolled and/or very large, they are set on the preparation tray 42, and the leading ends of the transfer and article are selected and aligned. Next, with the belts 6 and 9 translating, the user pays the assembly from the rolls, and lays the transfer out over the work surface area of and aligns the same along their side edges 106 so that it will feed squarely into the machine. In the printing of very wide articles, it is preferable that an operator be stationed at each side of the work area so as to accurately align the transfer and article. The transfer 104 is positioned on top of the belt 6 with the inked side 107 thereof disposed upwardly. The article 105 to be printed is then placed face down on top of the transfer, and the transfer and article are then aligned along the edges. Once the article 105 and transfer 104 are properly aligned, the operators simultaneously and evenly feed the same under the smoother roller 88 and toward the heat drum, by slowly releasing the transfer-article assembly and allowing the belt 6 to draw it into the printing machine. The operator then manipulates the lever 86 to achieve the desired compressive pressure on the assembly. The assembled transfer and article are thereby translated on the top or feed side 7 of the first belt 6, underneath the smoothing roller 88, to the feed point 83. The assembled transfer and article are then guided between the first and second belts 6 and 9, and the tension therein applies a uniform compressive pressure thereon. Continued belt translation rotates the assembled transfer and article arcuately about the heat drum 3 wherein heat is applied to the transfer and the sublimation dyestuffs are vaporized and penetrate the fibers of the article 105 to affect printing thereof. The transfer and article are then translated outwardly past the discharge point 84, and are deposited under gravitational forces into the discharge tray 11. The operator then separates the transfer 104 from the printed article 105.

It is to be understood that while I have illustrated and described certain forms of my invention, it is not to be limited to the specific forms or arrangements of parts herein described and shown.

What I claim and desire to secure by Letters Patent is:

1. A transfer printing machine for printing discrete articles with heat fixing sublimination dye, said machine comprising:

(a) a supportive frame;

(b) a heat drum rotatably mounted in said frame and extending laterally thereacross; heat being internally applied in substantially uniform amounts over a surface of said heat drum;

(c) a planar work surface member connected with said frame and extending substantially perpendicularly of said heat drum;

(d) a guide means mounted in a forward portion of said work surface member and extending laterally thereacross;

(e) a first endless belt being substantially impermeable to the sublimination dye and extending between and mounted on said heat drum and said guide means; said first endless belt forming a feed side, a return side, and a printing end which passes over a peripheral portion of said heat drum; said belt feed side overlying said work surface member and being supported thereby, and forming an area adapted for laying out and aligning in overlying fashion a transfer and an article to be printed, wherein said transfer is disposed abuttingly on top of said belt feed side and said article is positioned thereover;

(f) a second endless belt being substantially impermeable to the sublimination dye and mounted in said frame, overlying a portion of the printing end of said first belt, and translating synchronously therewith;

(g) synchronization means for positively synchronizing the movement of said first and second belts when said first belt is engaging said heat drum;

(h) power means for synchronously translating said first and second belts; and (i) means for urging said first and second belts against said heat drum and producing a substantially constant pressure between said first and second belts while said first belt is engaging said heat drum and enclosing said transfer and article, whereby translation of said first and second belts conveys said transfer and article from a first position above said work surface member; to a second position between said belts wherein pressure and heat from said heat drum sublimates and flows dye in the transfer outwardly onto said article for printing thereon; and thence to a third position wherein said transfer and article are discharged from between said belts.

2. A transfer printing machine is set forth in claim 1 wherein:

(a) said urging means for said first and second belts includes belt tightening means for stretching each of said belts into a taut condition, whereby uniform, non-localized compressive pressure is applied to said transfer and article throughout said second position.

3. A transfer printing machine as set forth in claim 1 wherein:

(a) said first and second belts are each constructed of woven glass fiber material.

4. A transfer printing machine as set forth in claim 3, wherein:

(a) said first and second belts each have an exterior surface thereof coated with a polytetrafluoroethylene material for resisting penetration of transfer dyes.

5. A transfer printing machine as set forth in claim 1, including:

(a) a feed roller, a discharge roller, and a return roller, each being positioned transversely in said frame for rotation, and having said second belt mounted thereon; and (b) said feed and discharge rollers each being positioned forward of said heat drum on the feed and return side respectively of said first belt, and respectively directing said second belt toward and away from the printing end of said first belt.

6. A transfer printing machine as set forth in claim 5, including:

(a) direct drive means operably interconnecting said heat drum and said feed roller for synchronous belt translation.

7. A transfer printing machine as set forth in claim 1, wherein:

(a) said first and second belts abuttingly converge at a feed point, extend about a peripheral portion of said heat drum, and diverge at a discharge point.

8. A transfer printing machine as set forth in claim 7 including:

(a) a discharge tray mounted laterally in said frame and positioned adjacent said discharge point, whereby said transfer and article are received and retained in said tray after printing.

9. A transfer printing machine as set forth in claim 1 wherein:

(a) said guide means comprises a guide roller rotatably mounted in said work surface member; and including (b) direct power transmission means operably interconnecting said heat drum and said guide roller, whereby said guide roller is driven for synchronous belt translation.

10. A transfer printing machine as set forth in claim 1 wherein:

(a) said first and second belts each have opposed side edges having a plurality of regularly spaced perforations therealong; and (b) said heat drum includes a sprocket at each end thereof having radially extending and regularly spaced teeth mating with said perforations for aligning said first and second belts and preventing relative translation therebetween.

11. A transfer printing machine as set forth in claim 10 wherein:

(a) each of said perforations has a generally oblong shape with the longer axis thereof aligned with the side edges of the belts.

12. A transfer printing machine as set forth in claim 1 wherein:

(a) said power means comprises an electric motor;

(b) said electric motor is connected with and drives said heat drum; and including (c) a clutch for selectively stopping and starting the translation of said belts; and (d) control means connected with said electric motor for varying the speed of heat drum rotation.

13. A transfer printing machine for printing discrete articles, said machine comprising:

(a) a supportive frame;

(b) a heat drum rotatably mounted in said frame and extending laterally thereacross;

(c) a planar work surface member connected with said frame and extending substantially perpendicularly of said heat drum;

(d) guide means mounted in a forward portion of said work surface member and extending laterally thereacross;

(e) a first endless belt extending between and mounted on said heat drum and said guide means; said first endless belt forming a feed side, a return side, and a printing end which passes over a portion of said heat drum; said belt feed side overlying said work surface member and being supported thereby, and forming an area adapted for laying out and aligning in overlying fashion a transfer and an article to be printed, wherein said transfer is disposed abuttingly on top of said belt feed side and said article is positioned thereover;

(f) a second endless belt mounted in said frame, overlying a portion of the printing end of said first belt, and translating synchronously therewith;

(g) power means for synchronously translating said first and second belts;

(h) means for urging said first and second belts against said heat drum, whereby translation of said first and second belts conveys said transfer and article from a first position above said work surface member; to a second position between said belts wherein heat from said heat drum sublimates and flows dye in the transfer outwardly onto said article for printing thereon; and thence to a third position wherein said transfer and article are discharged from between said belts; and (i) safety means mounted on said frame at a rearward portion of said work surface member and adjacent said first belt; said safety means being operably connected with said power means, whereby objects inadvertently situated between said first belt and said safety means activates said safety means thereof deactivating said power means and halting the translation of said belts.

* * * * *